US012498158B2

(12) United States Patent
Naik et al.

(10) Patent No.: US 12,498,158 B2
(45) Date of Patent: Dec. 16, 2025

(54) REFRIGERATOR ICE MAKER WITH SHUT OFF ARM POSITION SENSOR

(71) Applicant: Midea Group Co., Ltd., Foshan (CN)

(72) Inventors: Vinayak Naik, Louisville, KY (US); Eric L. Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 295 days.

(21) Appl. No.: 18/192,323

(22) Filed: Mar. 29, 2023

(65) Prior Publication Data

US 2024/0328696 A1 Oct. 3, 2024

(51) Int. Cl.
*F25C 1/24* (2018.01)
*F25C 5/187* (2018.01)

(52) U.S. Cl.
CPC ..... *F25C 1/24* (2013.01); *F25C 5/187* (2013.01); *F25C 2305/024* (2021.08); *F25C 2500/08* (2013.01); *F25C 2600/04* (2013.01); *F25C 2700/02* (2013.01)

(58) Field of Classification Search
CPC ..... F25C 1/24; F25C 5/187; F25C 2305/024; F25C 2500/08; F25C 2600/04; F25C 2700/02; F25C 5/22; F25D 29/008; F25D 2700/02; F25D 2700/122
See application file for complete search history.

(56) References Cited

U.S. PATENT DOCUMENTS

| | | | | |
|---|---|---|---|---|
| 3,885,400 | A * | 5/1975 | Webb | F25C 5/187 200/61.2 |
| 3,926,007 | A | 12/1975 | Braden et al. | |
| 3,964,269 | A | 6/1976 | Linstromberg | |
| 4,628,698 | A | 12/1986 | Needham et al. | |
| 4,872,318 | A | 10/1989 | Klemmensen | |
| 5,619,858 | A * | 4/1997 | Gunderson | F25C 5/187 62/344 |
| 6,334,319 | B1 * | 1/2002 | Senner | F25C 5/187 62/344 |
| 10,139,146 | B2 * | 11/2018 | Park | F25C 1/04 |
| 11,125,484 | B2 | 9/2021 | Chatelle et al. | |
| 11,313,602 | B2 | 4/2022 | Yun | |
| 2007/0186571 | A1 * | 8/2007 | Kopf | F25C 5/187 62/135 |
| 2012/0186288 | A1 | 7/2012 | Hapke | |

(Continued)

FOREIGN PATENT DOCUMENTS

| | | | |
|---|---|---|---|
| JP | H0719690 A | * | 1/1995 |
| JP | H0771852 A | * | 3/1995 |

(Continued)

OTHER PUBLICATIONS

GE; Board Asm Encoder by GE; AppliancePartsPros.com; 3 pages; retrieved from: https://www.appliancepartspros.com/answers-for-ge-board-asm-encoder-wr55x10625-ap3996141-question-258245.html; retrieved on Mar. 29, 2023.

*Primary Examiner* — Kun Kai Ma
(74) *Attorney, Agent, or Firm* — Gray Ice Higdon

(57) ABSTRACT

A refrigerator utilizes an ice maker including a shut off arm position sensor capable of sensing a plurality of positions of a shut off arm. Doing so may enable, for example, false full or empty indications to be detected, and in some instances, enable detection of potentially fused ice in a storage bin.

23 Claims, 5 Drawing Sheets

(56) References Cited

U.S. PATENT DOCUMENTS

| | | | | |
|---|---|---|---|---|
| 2017/0307277 | A1* | 10/2017 | Bertolini | F25C 5/187 |
| 2021/0302091 | A1* | 9/2021 | Olvera | F25C 1/04 |
| 2022/0235991 | A1* | 7/2022 | Shi | F25C 5/08 |

FOREIGN PATENT DOCUMENTS

| | | | | |
|---|---|---|---|---|
| JP | H11325677 | A | * | 11/1999 |
| KR | 20050026635 | A | | 3/2005 |
| KR | 100531302 | B1 | | 11/2005 |
| KR | 100565619 | B1 | | 3/2006 |
| KR | 100565630 | B1 | | 3/2006 |
| KR | 100577193 | B1 | | 5/2006 |
| WO | WO-2019176575 | A1 | * | 9/2019 |

* cited by examiner

REFRIGERATOR ICE MAKER WITH SHUT OFF ARM POSITION SENSOR

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. Various refrigerator designs have been used, including, for example, top mount refrigerators, which include a freezer compartment near the top of the refrigerator, either accessible via a separate external door from the external door for the fresh food compartment, or accessible via an internal door within the fresh food compartment; side-by-side refrigerators, which orient the freezer and fresh food compartments next to one another and extending generally along most of the height of the refrigerator; and bottom mount refrigerators, which orient the freezer compartment below the fresh food compartment and including sliding and/or hinged doors to provide access to the freezer and fresh food compartments.

Irrespective of the refrigerator design employed, many refrigerator designs also include an ice maker for producing ice and depositing the produced ice into a storage bin for later on-demand dispensing by a consumer. An ice maker may be disposed within the freezer compartment, and in some instances, may be disposed on an inwardly-facing side of an external door of the refrigerator. Further, in some instances, a refrigerator may also include an externally-accessible dispenser that is disposed at a convenient height on the front of the refrigerator to enable consumers to dispense ice, and in some instances, chilled water, without having to open any of the external doors of the refrigerator.

Many ice makers rely in part on a shut off arm to determine when a storage bin below the ice maker is full, and thus, when the ice maker should discontinue producing more ice. The shut off arm is generally coupled to a position switch such as a hall effect sensor or microswitch that changes state based upon the amount of ice in the storage bin when ice is dropped into the storage bin by the ice maker. However, it has been found that ice makers can sometimes produce "false" full or empty indications, e.g., due to ice clumping, mounding or melting, so a need exists in the art for a more reliable manner of sensing the volume of ice in an ice storage bin.

SUMMARY

The herein-described embodiments address these and other problems associated with the art by providing a refrigerator that utilizes an ice maker incorporating a shut off arm position sensor capable of sensing a plurality of positions of a shut off arm. Doing so may enable, for example, false full or empty indications to be detected, and in some instances, enable detection of potentially fused ice in a storage bin.

Therefore, consistent with one aspect of the invention, a refrigerator may include a cabinet including one or more food compartments and one or more doors closing the one or more food compartments, an ice maker disposed in the cabinet to produce ice, a storage bin configured to store ice produced by the ice maker, a shut off arm positioned to sense an amount of ice stored in the storage bin, and a shut off arm position sensor operably coupled to the shut off arm and configured to sense a plurality of positions of the shut off arm.

In addition, in some embodiments, the shut off arm position sensor is configured to sense a range of positions of the shut off arm. Further, in some embodiments, the shut off arm position sensor is configured to sense three or more positions of the shut off arm. Moreover, in some embodiments, the shut off arm position sensor includes an encoder.

Further, in some embodiments, at least a portion of the shut off arm rotates about an axis between a full position and an empty position, and the encoder is a rotary encoder configured to sense a rotational position of the portion of the shut off arm about the axis. In some embodiments, at least a portion of the shut off arm moves linearly between a full position and an empty position, and the encoder is a linear encoder configured to sense a linear position of the portion of the shut off arm.

Moreover, in some embodiments, the shut off arm position sensor includes a potentiometer. Further, in some embodiments, the shut off arm is operably coupled to a first gear and the shut off arm position sensor is operably coupled to a second gear, and the first and second gears are operably coupled to one another and have a first gear to second gear ratio greater than one. In addition, some embodiments may also include an ice drop mechanism, and the shut off arm is operably coupled to the ice drop mechanism to move through a range of positions during an ice drop operation performed with the ice drop mechanism.

Some embodiments may also include a controller coupled to the ice maker and the shut off arm position sensor, and the controller is configured to detect potentially fused ice in the storage bin using the shut off arm position sensor. Moreover, in some embodiments, the controller is configured to detect potentially fused ice in the storage bin by detecting a drop in ice level in the storage bin using the shut off arm position sensor. In some embodiments, the controller is further configured to detect a door open event when a door to a freezer compartment has been opened, and to detect potentially fused ice in the storage bin by detecting the drop in ice level in the storage bin using the shut off arm position sensor after no door open events.

Further, in some embodiments, the controller is further configured to detect an ice dispense event when ice is dispensed from an ice dispenser, and to detect potentially fused ice in the storage bin by detecting the drop in ice level in the storage bin using the shut off arm position sensor after no ice dispense events. Also, in some embodiments, the controller is further configured to detect a defrost event when a defrost cycle is run in a freezer compartment, and to detect potentially fused ice in the storage bin by detecting the drop in ice level in the storage bin using the shut off arm position sensor after one or more defrost events.

Further, in some embodiments, the controller is further configured to detect an above freezing event when an above freezing temperature is detected in a freezer compartment, and to detect potentially fused ice in the storage bin by detecting the drop in ice level in the storage bin using the shut off arm position sensor after one or more above freezing events.

Also, in some embodiments, the controller is configured to alert a user of the potentially fused ice in response to detecting potentially fused ice in the storage bin. In addition, in some embodiments, the controller is configured to alert the user of the potentially fused ice while temporarily disabling an ice dispenser in response to a user attempting to dispense ice from the ice dispenser after the controller detects the potentially fused ice in the storage bin.

In addition, some embodiments may further include a controller coupled to the ice maker and the shut off arm position sensor, and the controller is configured to determine a storage bin ice level in connection with performing an ice drop operation with the ice maker, and to detect a false full event based upon the determined storage bin ice level. In some embodiments, the controller is configured to detect the false full event in response to a change in shut off arm position as a result of the ice drop operation that differs from an expected change in shut off arm position. Further, in some embodiments, the controller is configured to alert a user to agitate the storage bin in response to detecting the false full event. Some embodiments may also include an ice mover disposed in the storage bin, and the controller is configured to activate the ice mover in response to detecting the false full event. Some embodiments may further include an ice agitator disposed in the storage bin, and the controller is configured to activate the ice agitator in response to detecting the false full event.

Consistent with another aspect of the invention, an ice maker may include an ice mold configured to produce ice, an ice drop mechanism configured to drop ice produced by the ice mold into a storage bin, a shut off arm positioned to sense an amount of ice stored in the storage bin, and a shut off arm position sensor operably coupled to the shut off arm and configured to sense a plurality of positions of the shut off arm.

Consistent with another aspect of the invention, a refrigerator may include a cabinet including one or more food compartments and one or more doors closing the one or more food compartments, an ice maker disposed in the cabinet to produce ice, a storage bin configured to store ice produced by the ice maker, an ice mover disposed in the storage bin and configured to move ice stored in the storage bin to a dispenser output in response to user input to dispense ice, a shut off arm positioned to sense an amount of ice stored in the storage bin, a shut off arm position sensor operably coupled to the shut off arm and configured to sense a plurality of positions of the shut off arm, and a controller coupled to the ice maker, the ice mover and the shut off arm position sensor, the controller configured to detect potentially fused ice in the storage bin using the shut off arm position sensor, receive user input to dispense ice, and in response to the receiving the user input to dispense ice after detecting potentially fused ice in the storage bin using the shut off arm position sensor, temporarily disable the ice mover and alert a user of potentially fused ice in the storage bin.

Other embodiments may include various methods for making and/or using any of the aforementioned constructions.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Embodiments of the invention are directed in part to the use of a shut off arm position sensor to capable of sensing multiple positions of an ice maker shut off arm. As opposed to a shut off arm switch that is binary in nature, and that is only capable of detecting whether or not a shut off arm is at a predetermined position, a shut off arm position sensor may be capable of sensing various conditions, such as ice clumping, mounding or melting (which can lead to potentially fused ice in the storage bin), or false full or empty indications, which can then be rectified in an automatic or manual manner, potentially leading to improved ice maker performance and reliability.

Figure 1:
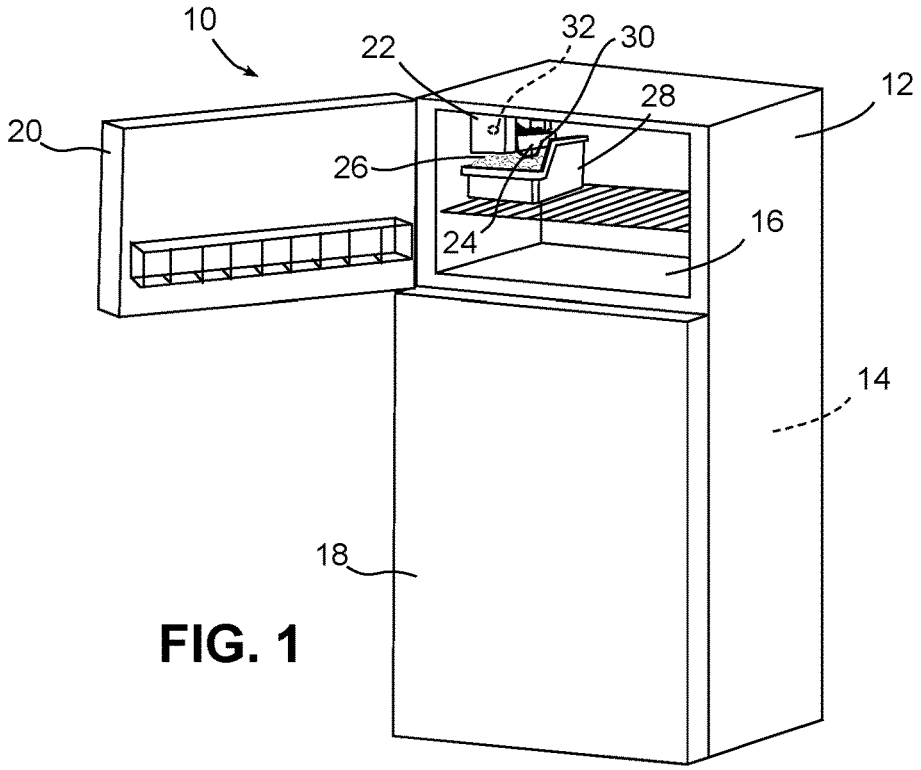
FIG. 1 is a perspective view of an example implementation of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12 including one or more food storage compartments (e.g., a fresh food compartment 14 and a freezer compartment 16), as well as one or more fresh food compartment doors 18 and one or more freezer compartment doors 20 disposed adjacent respective openings of food storage compartments 14, 16 and configured to insulate the respective food storage compartments 14, 16 from an exterior environment when the doors are closed.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a top mount refrigerator, where freezer compartment 16 is disposed above fresh food compartment 14, and where a single hinged door 18, 20 provides access to each compartment 14, 16. It will be appreciated, however, that other door designs may be used in other embodiments, including various combinations and numbers of hinged and/or sliding doors for each of the fresh food and freezer compartments (e.g., a pair of French fresh food and/or freezer doors, one or more sliding freezer doors, or more than one hinged fresh food door and/or freezer door). Moreover, while refrigerator 10 is a top mount refrigerator, the invention is not so limited, and as such, the principles and techniques may be used in connection with other types of refrigerators in other embodiments, e.g., bottom mount refrigerators, side-by-side refrigerators, etc.

Figure 2:
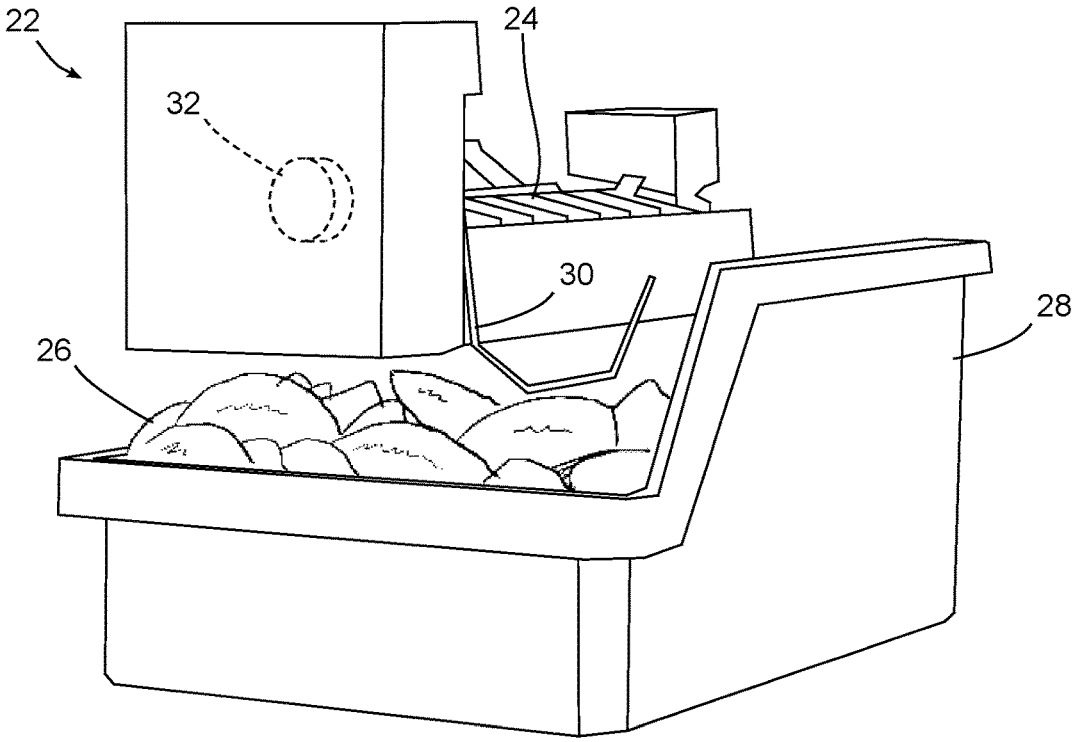
FIG. 2 is a perspective view of the ice maker in the refrigerator of FIG. 1.

With additional reference to FIG. 2, refrigerator also includes, within freezer compartment 16, an ice maker 22 that includes an ice making mold 24 capable of dispensing ice 26 into a storage bin 28. As will become more apparent below, ice maker 22 also includes a shut off arm 30 that is operably coupled to a shut off arm position sensor 32 that is capable of sensing a plurality of positions of the shut off arm 30, i.e., including one or more intermediate positions beyond positions corresponding to "full" and "empty" levels of ice within storage bin 28.

While not illustrated in FIG. 1, refrigerator 10 may also include, in some embodiments, a dispenser for dispensing ice and/or water, which in some embodiments may be disposed on an external surface of the refrigerator, and which may include one or more external user controls and/or displays. A dispenser in various embodiments may be capable of dispensing both ice and chilled water, while in other embodiments, the dispenser may be an ice only dispenser for dispensing only cubed and/or crushed ice. In still other embodiments, the dispenser may additionally dispense hot water, sparkling water, coffee, beverages, or other liquids, and may have variable and/or fast dispense capabilities. In some instances, ice and water may be dispensed from the same location, while in other instances separate locations may be provided in the dispenser for dispensing ice and water.

Figure 3:
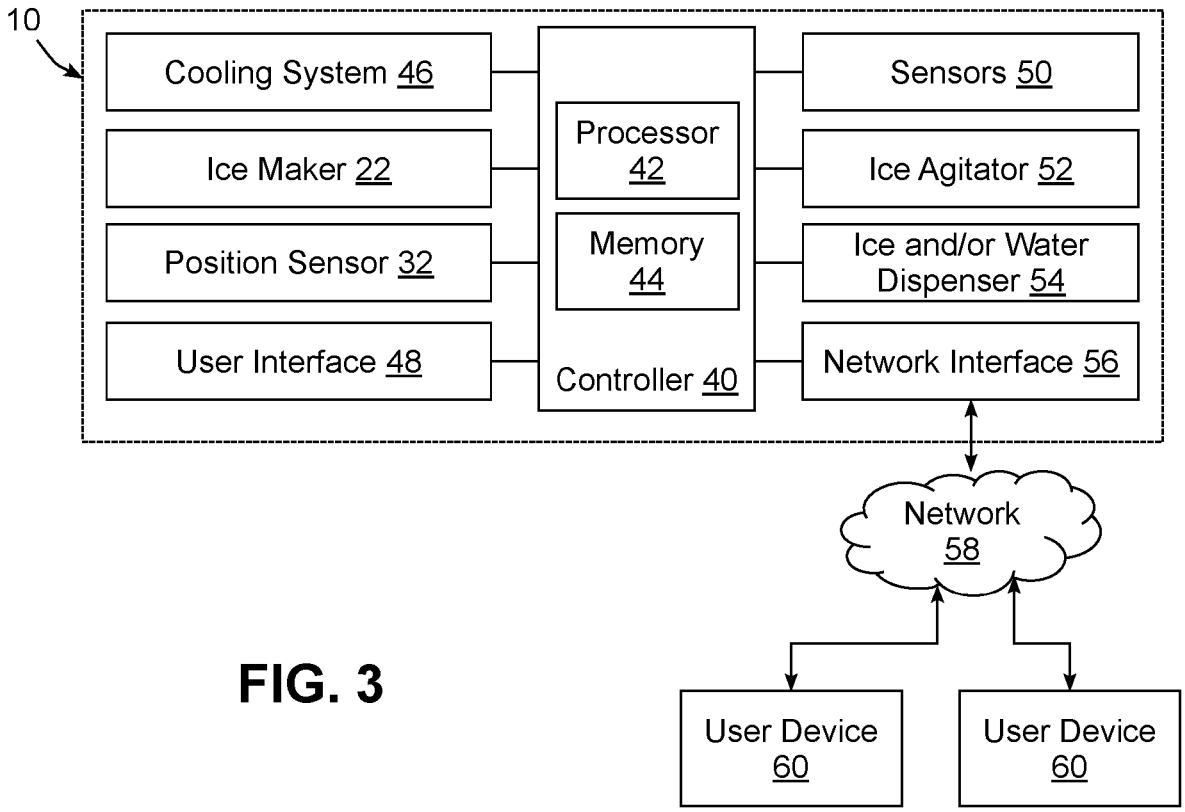
FIG. 3 is a block diagram of an example control system for the refrigerator of FIG. 1.

A refrigerator consistent with the invention also generally includes one or more controllers configured to control a refrigeration system as well as manage interaction with a user. FIG. 3, for example, illustrates a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 3, controller 40 may be interfaced with various components, including, in addition to ice maker 22 and position sensor 32 discussed above, a cooling or refrigeration system 46. In addition, in some embodiments, controller 40 may also be coupled to a user interface 48 including one or more user controls for receiving user input (e.g., various combinations of switches, knobs, buttons, sliders, touchscreens or touch-sensitive displays, microphones or audio input devices, image capture devices, etc.), and one or more user displays (including various indicators, graphical displays, textual displays, speakers, etc.). Controller 40 may also be coupled to various additional components suitable for use in a refrigerator, e.g., various sensors 50 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. In one example embodiment, sensors 50 may include door sensors for sensing when the doors of the refrigerator and freezer compartment have been opened, as well as a defrost thermistor for sensing temperature for the purpose of initiating a defrost cycle.

Controller 40 may also, in some embodiments, be coupled to an ice agitator 52 capable of agitating ice in storage bin 28 to break up any clumps of ice that may be forming in the storage bin. In addition, as noted above, controller 40 may also be coupled to an ice and/or water dispenser 54 to dispense ice, water or other fluids on-demand to a consumer.

In some embodiments, controller 40 may also be coupled to one or more network interfaces 56, e.g., for interfacing with external devices via wired and/or wireless networks such as Ethernet, Wi-Fi, Bluetooth, NFC, cellular and other suitable networks, collectively represented in FIG. 2 at 58. Network 58 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 60 over network 58, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-3 will be apparent to one of ordinary skill in the art, as will become apparent from the description below. Therefore, the invention is not limited to the specific implementations discussed herein.

Ice Maker Shut Off Arm Position Sensor

A shut off arm is generally used on an ice maker to detect when a storage bin or ice bucket within which ice produced by an ice maker is full or empty, and will generally be used to trigger another ice production operation by the ice maker whenever the storage bin is determined to not be full, such that the storage bin may be kept full as often as possible should a consumer ever desire to use a large quantity of ice. Generally, whether or not a storage bin is full is determined by dropping the shut off arm down into the storage bin in connection with dropping ice produced by the ice maker into the storage bin, e.g., by twisting and/or inverting the ice mold within which the ice is produced, or by rotating a rake through the mold to dislodge the ice into the storage bin. If the level of ice in the storage bin is below a preset level, then the shut off arm is allowed to drop to a position that triggers a switch, e.g., a microswitch, button, or hall effect sensor, such that an absence of the switch being triggered during an ice drop operation indicates that the storage bin is full.

However, the binary nature of a shut off arm position switch can lead to several issues in a refrigerator. For example, because the level of ice in a storage bin is generally measured at one point, should ice mound near that point, a "false" full indication may be made. In addition, ice in a storage bin may clump, mound or melt when allowed to sit undisturbed for a prolonged period of time while being subjected to temperature variations, e.g., as may occur during a defrost cycle or as a result of a consumer opening a freezer door. The ice level may drop as a result of such clumping, mounding or melting, and may potentially result in a "false" empty indication. Also importantly, should ice clump, mound or melt within a storage bin that is used by an ice dispenser, the individual ice cubes may fuse together and the ice mover of the ice dispenser, e.g., an auger disposed in the storage bin, may become frozen in place, such that if a consumer attempts to dispense ice, the ice mover will not dispense ice, or potentially may fail as a result of the increased forces to which it is subjected by the fused ice when activated.

Embodiments consistent with invention, on the other hand, may utilize a shut off arm position sensor that is capable of sensing a plurality of positions of a shut off arm, i.e., including one or more intermediate positions beyond positions corresponding to "full" and "empty" levels of ice within a storage bin. In some embodiments, a shut off arm position sensor may sense three or more positions, e.g., a full position, an empty position, and one or more intermediate positions, and in some embodiments, a shut off arm position sensor may sense a range of positions, including a substantially continuous range of positions. For example, it may be desirable in some embodiments to utilize an encoder, e.g., a rotary encoder capable of measuring rotation of the shut off arm, or a linear encoder capable of measuring linear movement of the shut off arm. In some embodiments, a rotary encoder may have a resolution of one degree or a fraction of a degree, while a linear encoder may have a resolution of one or a few millimeters. Alternatively, a potentiometer or other analog sensor may be used to sense a continuous range of rotational or linear positions. Other position sensor implementations capable of sensing more than a binary "full" or "empty" indication may be used in other embodiments.

FIG. 2, discussed above, discloses one potential implementation of a shut off arm position sensor 32, which senses movement of shut off arm 30 in an ice maker 22. Ice maker 22 includes a rake-type ice drop mechanism that drops ice into a storage bin 26 that is positioned in a freezer compartment, but is not associated with any ice dispenser.

Figure 4:
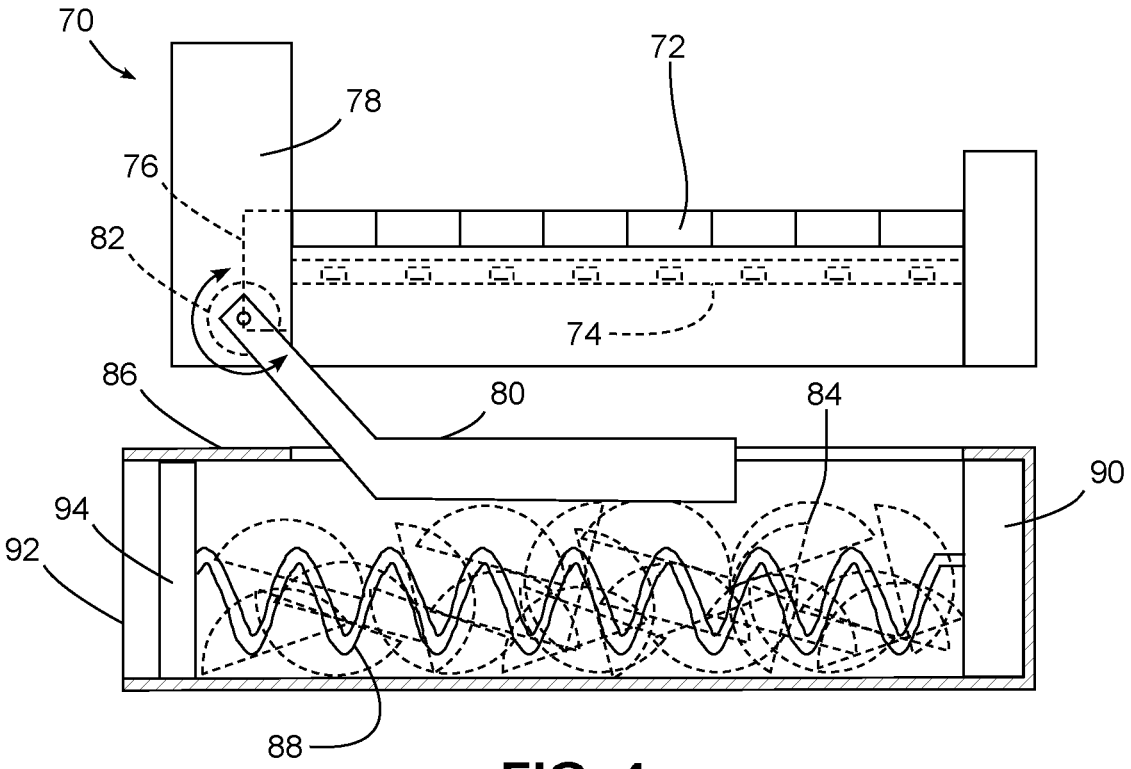
FIG. 4 is a side cross-sectional view of another ice maker including a shut off arm position sensor consistent with some embodiments of the invention.

FIG. 4 illustrates another potential implementation of a shut off arm position sensor, in which an ice maker 70 includes a mold 72 and a rake-type ice drop mechanism 74 that is driven by a motor 76 within a housing 78 to dislodge ice cubes from mold 72. A shut off arm 80 is rotatably coupled to housing 78, and is driven by motor 76 concurrently with activation of rake-type ice drop mechanism 74, and a shut off arm position sensor 82, e.g., a rotary encoder, is used to sense a position of shut off arm 80. Ice maker 22 drops ice 84 into a storage bin 86 that includes an ice mover 88, here an auger, that is driven by a motor 90 to push ice towards a dispenser outlet 92. In some embodiments, a crushing mechanism 94 may also be included to crush ice prior to dispensing from dispenser outlet 92.

Figure 5:
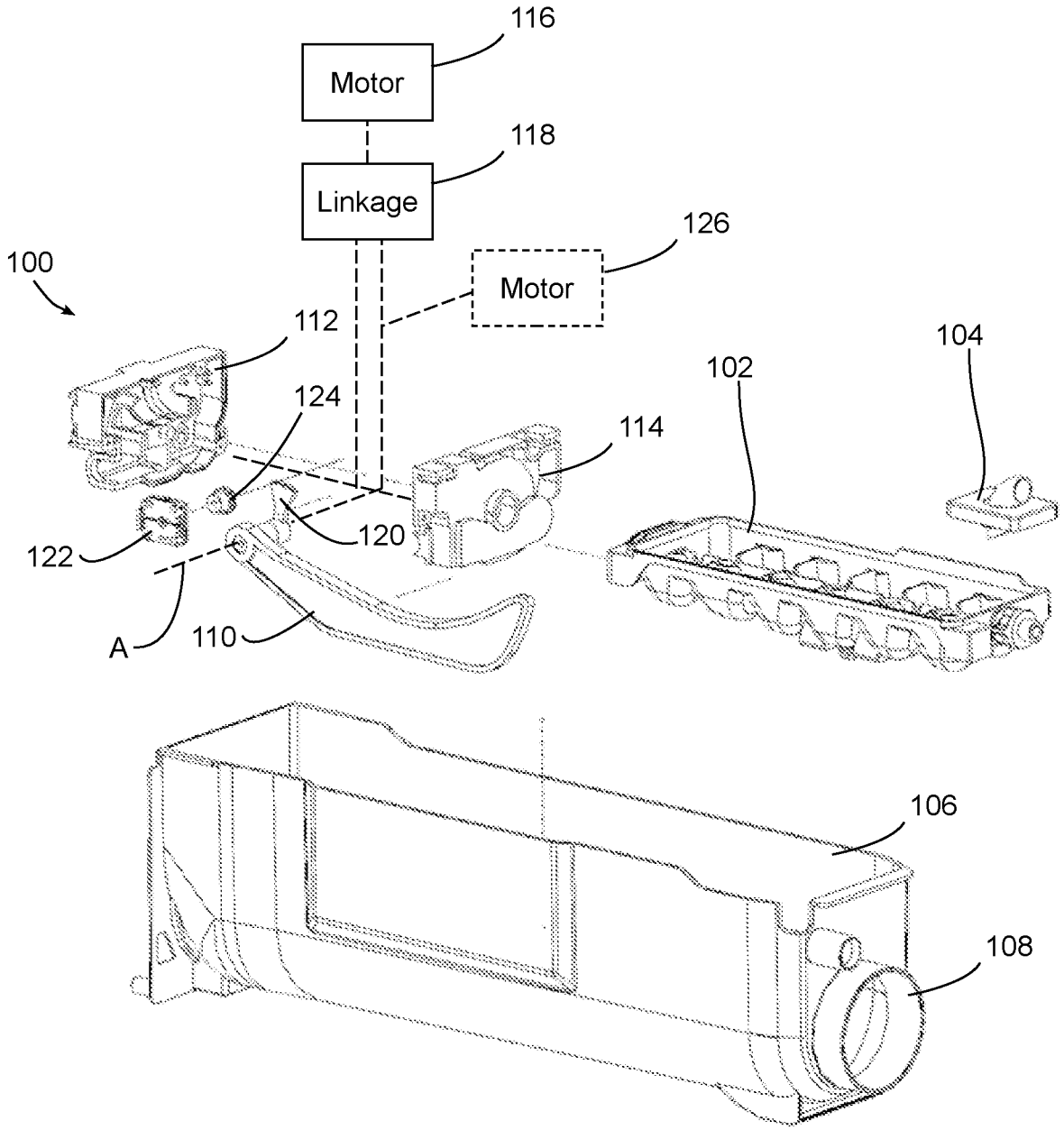
FIG. 5 is an exploded perspective view of yet another ice maker including a shut off arm position sensor consistent with some embodiments of the invention.

FIG. 5 next illustrates another potential implementation of a shut off arm position sensor, in which an ice maker 100 includes a mold 102 that is filled with water by a fill valve 104, and that drops produced ice into a storage bin 106 having a dispenser outlet 108. A shut off arm 110 is rotatably mounted to a housing including housing members 112, 114, and a motor 116 is coupled via a linkage 118 to mold 102 to serve as an ice drop mechanism that twists and rotates mold 102 to drop ice into storage bin 106, as well as to rotate shut off arm 110 about an axis A. In some embodiments, for example, linkage 118 may include a cam mechanism that, between ice drop operations, holds shut off arm in the position illustrated in FIG. 5, and then during an ice drop operation, allows shut off arm 110 to rotate up to a maximum of about 40 degrees downwardly from the position illustrated in FIG. 5 and back up to its original position in connection with a 360 degree rotation of mold 102, such that activation of the ice drop mechanism drops ice from mold 102 and causes shut off arm to drop into storage bin 106 to determine the level of ice in the storage bin.

In this embodiment, rather than having an shut off arm position sensor that is coaxial with rotation of shut off arm 110, shut off arm 110 is operably coupled to a first gear 120 and a shut off arm position sensor 122, e.g., implemented as a rotary encoder, is operably coupled to a second gear 124 that engages with first gear 120. Gears 122, 124 are configured such that a gear ration between gears 122, 124 is greater than one, i.e., so that rotation of shut off arm 110 and first gear 120 about axis A causes a relatively greater rotation of second gear 124, thereby increasing the effective resolution of shut off arm position sensor 122.

In addition, while in this embodiment a linkage 118 is used to enable motor 116 to drive both the ice drop mechanism and shut off arm 110, in other embodiments, and as illustrated by motor 126, shut off arm 110 may be driven independently of an ice drop mechanism.

Figure 6:
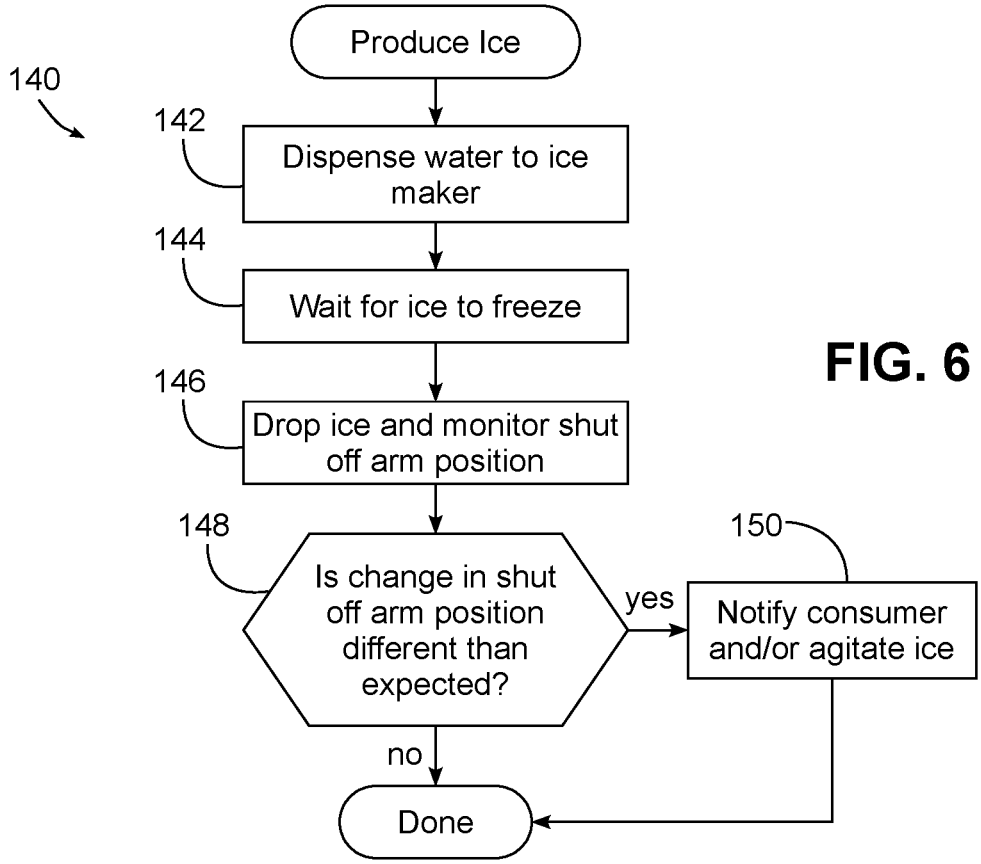
FIG. 6 is a flowchart illustrating an example operational sequence for producing ice consistent with some embodiments of the invention.
Figure 7:
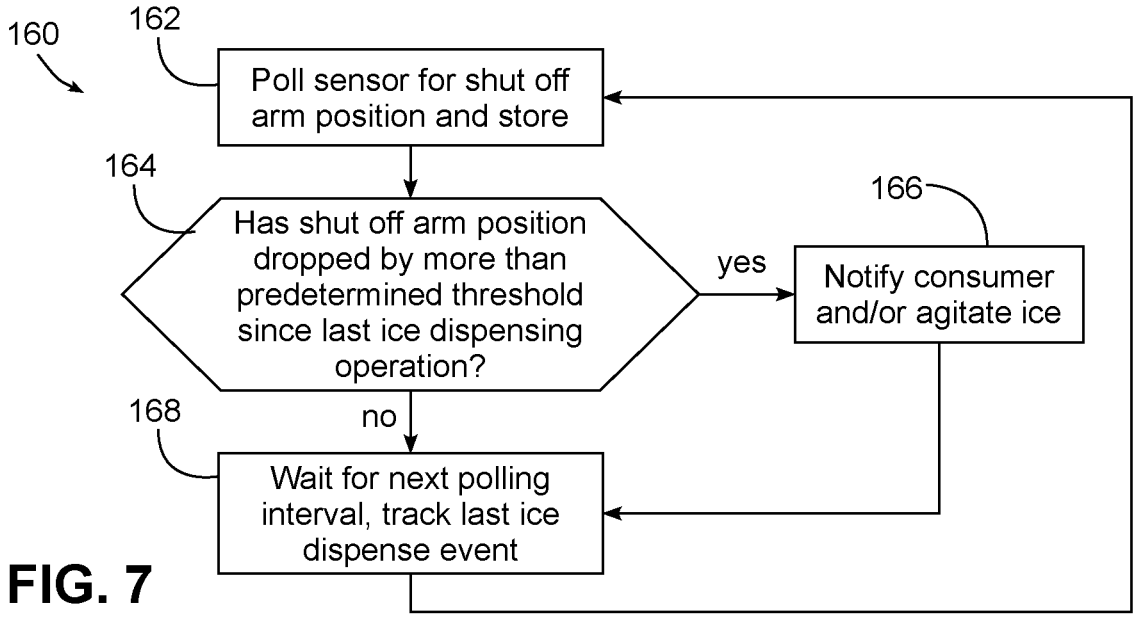
FIG. 7 is a flowchart illustrating an example operational sequence for monitoring a shut off arm position and detecting potentially fused ice in a storage bin consistent with some embodiments of the invention.
Figure 8:
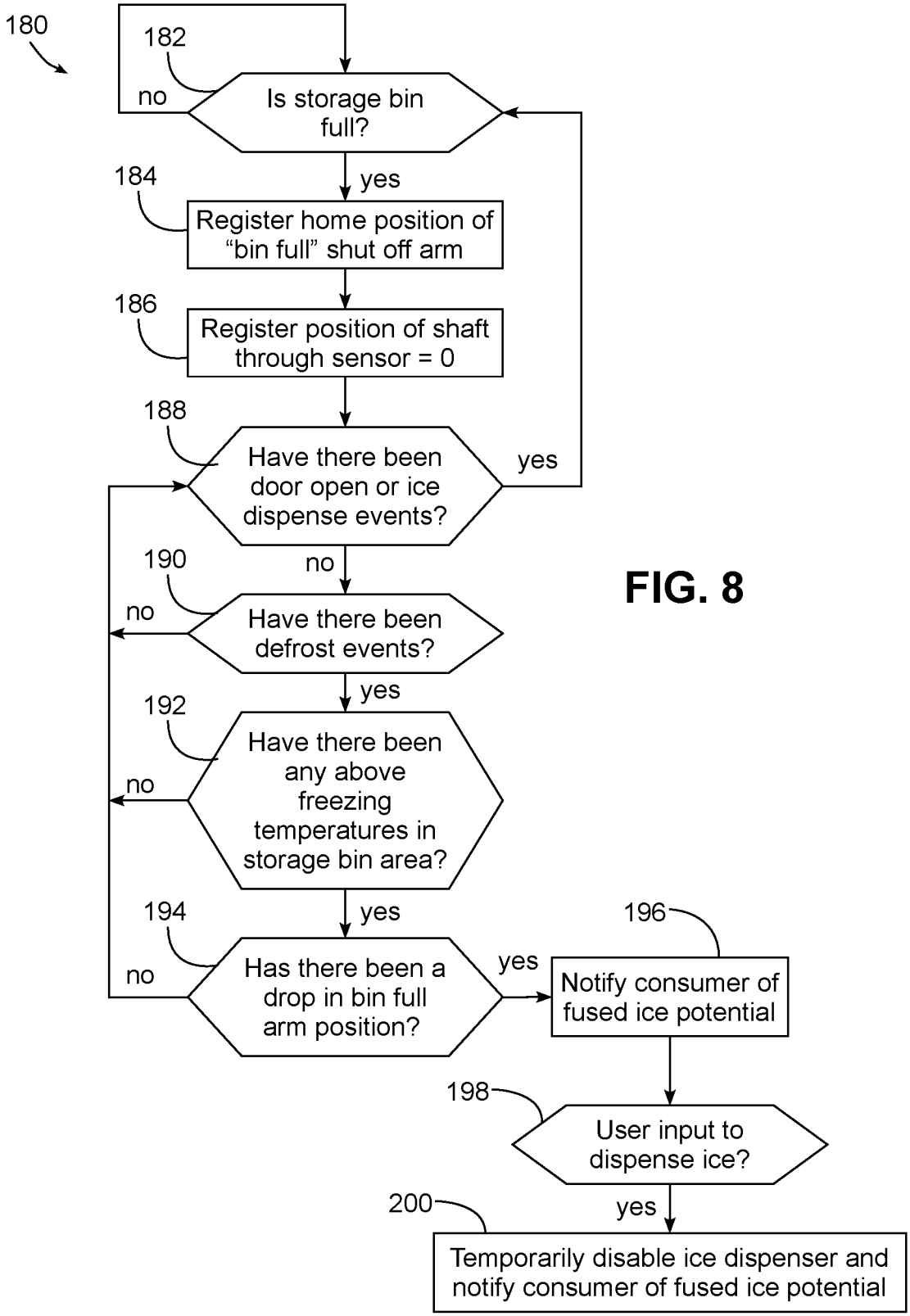
FIG. 8 is a flowchart illustrating an example operational sequence for detecting potentially fused ice in a storage bin consistent with some embodiments of the invention.

Now turning to FIGS. 6-8, a number of operational sequences are illustrated showing various manners in which a shut off arm position sensor may be used to detect various conditions in a storage bin. FIG. 6, for example, illustrates an operational sequence 140 suitable for producing ice in an ice maker, e.g., any of ice makers 22, 70 and 100 discussed above. In block 142, upon initiation of an ice production operation, water is dispensed to the ice maker to fill the mold with water, and in block 144, the water is allowed to freeze into ice cubes. Next, in block 146, an ice drop operation is initiated to drop the produced ice into a storage bin. During this operation, the shut off arm is dropped to sense the level of ice, and the shut off arm position sensor is monitored to determine how far the shut off arm drops during this operation. Block 148 then determines if the change in shut off arm position is different than that expected. For example, if it is known (e.g., through empirical testing) that a batch of ice produced by an ice maker causes an increase in ice level in the storage bin of about 20 cm, any ice level change (e.g., a change in the current ice level sensed after the current ice drop operation from an ice level sensed after a prior ice drop operation or from an ice level sensed immediately prior to the current ice production operation or current ice drop operation) that departs from this anticipated distance may indicate a sub-optimal condition in the storage bin, e.g., ice that has been dropped in one area and has mounded or heaped in that area (indicative of a "false" full indication). In such an event, control may pass to block 150 to either notify the consumer of a potential need to agitate the ice (e.g., by presenting a message on a refrigerator display, a mobile device app, an email, a message, etc., recommending that the consumer shake or agitate the storage bin), or to actually agitate the ice, and the ice production operation is complete. Automatic agitation of the ice in some embodiments may include briefly running the ice mover of an ice dispenser (in some embodiments, in a reverse direction from a dispensing direction, or in multiple directions). In other embodiments, a dedicated agitator may be used, e.g., by activating a stirrer, an eccentric weight that induces vibration of the storage bin, or in other suitable manners. Returning to block 148, if an expected change is detected, block 150 is bypassed, and the ice production operation is complete.

FIG. 7 illustrates another operational sequence 160 suitable for monitoring ice level in a storage bin and detecting potentially fused ice in a storage bin, and may begin in block 162 by polling the shut off arm position sensor and storing the sensed position. In some embodiments, the shut off arm may be actuated, either by performing an ice drop operation, or by independently actuating the shut off arm to sense the level of ice. Block 164 then determines if the shut off arm position has dropped by more than a predetermined threshold since the last ice dispensing operation, indicating that a potential exists that ice in the storage bin has potentially fused together, e.g., as a result of clumping, mounding or melting while in the storage bin. Such a condition, which in some instances may be considered a "false" empty indication, also presents the possibility of fused ice being in the storage bin, which in some circumstances may present a risk of breakage should a auger or other ice mover of an ice dispenser be frozen in the ice. Thus, if the shut off arm position has dropped more than the threshold, block 164 may pass control to block 166 to either notify the consumer (e.g., via a refrigerator display, a mobile device app, an email, a message, etc.) to remove or otherwise break up any fused ice, or if appropriate, to automatically agitate the ice).

Control then passes to block 168 to wait for a next polling interval. In addition, during this time a last ice dispense event is tracked, since it will be appreciated that any dispensing of ice will lower the level of ice in the storage bin, thereby affecting the detection of any potentially fused ice in block 164. In addition, returning to block 164, if no potentially fused ice is detected in block 164, block 166 is bypassed, and control passes to block 168 to wait for the next polling interval. At the next polling interval, control returns to block 162.

FIG. 8 illustrates another operational sequence 180 suitable for detecting potentially fused ice in the storage bin, and relies on a number of additional input sources, including one or more of a door sensor that detects opening of a freezer door, a defrost thermistor that senses temperature proximate the storage bin, a count of ice dispensing operations maintained by a controller, and a count of defrost events maintained by a controller. In other embodiments, only a subset of these input sources may be used.

In the illustrated embodiment, block 182 first determines whether the storage bin is full, i.e., after a last ice production and ice drop operation, a full storage bin was detected based on the sensed position of the shut off arm. If not, control returns to block 182 until the storage bin is determined to be full. If so, however, control passes to block 184 to register the home position of the shut off arm when in the "bin full" position. Block 186 then causes the shut off arm to move down to contact the ice and return to the home position. If the shut off arm cannot move downwards, that means the bucket is full. If it can move all the way down (e.g., about 40 degrees in some embodiments), the storage bin may be determined to be empty. If it moves some amount between these extremes, then the percentage that the storage bin is full may be determined (e.g., about 10 degrees would correspond to about ¾ full).

Block 188 then determines whether there have been any door open or ice dispense events, and if so, control returns to block 182. If not, however, control passes to block 190 to determine whether any defrost events have occurred. If not, control returns to block 188, but if so, control passes to block 192 to determine if any above freezing temperatures have been detected proximate the storage bin (also referred to herein as an above freezing event). If not, control returns to block 188, and if so, control passes to block 194 to determine if there has been any drop in the bin full shut off arm position, e.g., based upon independent actuation of the shut off arm, or activation of the ice drop mechanism and the shut off arm (in the event those components are linked). If no drop is detected, control returns to block 188, and but a drop is detected, fused ice potentially is present in the storage bin, so control passes to block 196 to notify the consumer of the fused ice potential, e.g., via a refrigerator display, a mobile device app, an email, a message, etc.

In addition, as illustrated in blocks 198 and 200, it may also be desirable to, after determining that a risk of fused ice exists, temporarily disable an ice dispenser and notify a consumer in response to an attempt to dispense ice using the ice dispenser. For example, if a consumer attempts to dispense ice after such a determination has been made, a risk may exist that activating the ice dispenser could lead to a breakage in the ice mover mechanism should it be frozen in fused ice. Thus, it may be desirable to, rather than activate the ice mover mechanism, issue an alert and suggest to the consumer to check the storage bin for any fused ice, and to break up or otherwise remove the fused ice prior to attempting to dispense ice a second time. In some instances, a consumer may be required to confirm that he or she has checked the storage bin prior to re-enabling the ice dispenser. As such, the risk of damage to the ice mover as a result of fused ice may be decreased.

It will be appreciated that in sequence 180, potentially fused ice is detected based upon the presence of, from the last time that the storage bin was detected as full, no door open or ice dispense events (each of which is associated with the potential for either manual removal of ice from the storage bin when the door is opened or automated removal of ice from the storage bin from the ice dispense event), coupled with the presence of one or more defrost events and one or more above freezing events, as well as a detected dropped ice level in the storage bin. In other embodiments, other criteria may be used to detect potentially fused ice, including a subset of door open, ice dispense, defrost, and above freezing events, as well as the use of time-based criteria, e.g., when a predetermined duration (e.g., 48 hours) has passed since any doors were opened or ice was dispensed.

It will be appreciated that, while certain features may be discussed herein in connection with certain embodiments and/or in connection with certain figures, unless expressly stated to the contrary, such features generally may be incorporated into any of the embodiments discussed and illustrated herein. Moreover, features that are disclosed as being combined in some embodiments may generally be implemented separately in other embodiments, and features that are disclosed as being implemented separately in some embodiments may be combined in other embodiments, so the fact that a particular feature is discussed in the context of one embodiment but not another should not be construed as an admission that those two embodiments are mutually exclusive of one another. Various additional modifications may be made to the illustrated embodiments consistent with the invention. Therefore, the invention lies in the claims hereinafter appended.

What is claimed is:

1. A refrigerator, comprising:

a cabinet including one or more food compartments and one or more doors closing the one or more food compartments;

an ice maker disposed in the cabinet to produce ice;

a storage bin configured to store ice produced by the ice maker;

a shut off arm positioned to sense an amount of ice stored in the storage bin; and a shut off arm position sensor operably coupled to the shut off arm and configured to sense a plurality of positions of the shut off arm, wherein the shut off arm position sensor comprises an encoder.

2. The refrigerator of claim 1, wherein the shut off arm position sensor is configured to sense a range of positions of the shut off arm.

3. The refrigerator of claim 1, wherein the shut off arm position sensor is configured to sense three or more positions of the shut off arm.

4. The refrigerator of claim 1, wherein at least a portion of the shut off arm rotates about an axis between a full position and an empty position, and wherein the encoder is a rotary encoder configured to sense a rotational position of the portion of the shut off arm about the axis.

5. The refrigerator of claim 1, wherein at least a portion of the shut off arm moves linearly between a full position and an empty position, and wherein the encoder is a linear encoder configured to sense a linear position of the portion of the shut off arm.

6. The refrigerator of claim 1, wherein the shut off arm is operably coupled to a first gear and the shut off arm position sensor is operably coupled to a second gear, and wherein the first and second gears are operably coupled to one another and have a first gear to second gear gear ratio greater than one.

7. The refrigerator of claim 1, further comprising an ice drop mechanism, wherein the shut off arm is operably coupled to the ice drop mechanism to move through a range of positions during an ice drop operation performed with the ice drop mechanism.

8. The refrigerator of claim 1, further comprising a controller coupled to the ice maker and the shut off arm position sensor, wherein the controller is configured to detect potentially fused ice in the storage bin using the shut off arm position sensor.

9. The refrigerator of claim 8, wherein the controller is configured to detect potentially fused ice in the storage bin by detecting a drop in ice level in the storage bin using the shut off arm position sensor.

10. The refrigerator of claim 9, wherein the controller is further configured to detect a door open event when a door to a freezer compartment has been opened, and to detect potentially fused ice in the storage bin by detecting the drop in ice level in the storage bin using the shut off arm position sensor after no door open events.

11. The refrigerator of claim 9, wherein the controller is further configured to detect an ice dispense event when ice is dispensed from an ice dispenser, and to detect potentially fused ice in the storage bin by detecting the drop in ice level in the storage bin using the shut off arm position sensor after no ice dispense events.

12. The refrigerator of claim 9, wherein the controller is further configured to detect a defrost event when a defrost cycle is run in a freezer compartment, and to detect potentially fused ice in the storage bin by detecting the drop in ice level in the storage bin using the shut off arm position sensor after one or more defrost events.

13. The refrigerator of claim 9, wherein the controller is further configured to detect an above freezing event when an above freezing temperature is detected in a freezer compartment, and to detect potentially fused ice in the storage bin by detecting the drop in ice level in the storage bin using the shut off arm position sensor after one or more above freezing events.

14. The refrigerator of claim 9, wherein the controller is configured to alert a user of the potentially fused ice in response to detecting potentially fused ice in the storage bin.

15. The refrigerator of claim 14, wherein the controller is configured to alert the user of the potentially fused ice while temporarily disabling an ice dispenser in response to a user attempting to dispense ice from the ice dispenser after the controller detects the potentially fused ice in the storage bin.

16. A refrigerator, comprising:

a cabinet including one or more food compartments and one or more doors closing the one or more food compartments;

an ice maker disposed in the cabinet to produce ice;

a storage bin configured to store ice produced by the ice maker;

a shut off arm positioned to sense an amount of ice stored in the storage bin;

a shut off arm position sensor operably coupled to the shut off arm and configured to sense a plurality of positions of the shut off arm; and a controller coupled to the ice maker and the shut off arm position sensor, wherein the controller is configured to determine, using the shut off arm position sensor, a storage bin ice level in connection with performing an ice drop operation with the ice maker, and to detect a false full event based upon the storage bin ice level determined using the shut off arm position sensor.

17. The refrigerator of claim 16, wherein the controller is configured to detect the false full event in response to a change in shut off arm position as a result of the ice drop operation that differs from an expected change in shut off arm position.

18. The refrigerator of claim 17, wherein the controller is configured to alert a user to agitate the storage bin in response to detecting the false full event.

19. The refrigerator of claim 17, further comprising an ice mover disposed in the storage bin, wherein the controller is configured to activate the ice mover in response to detecting the false full event.

20. The refrigerator of claim 17, further comprising an ice agitator disposed in the storage bin, wherein the controller is configured to activate the ice agitator in response to detecting the false full event.

21. The refrigerator of claim 16, wherein the shut off arm position sensor comprises an encoder.

22. A refrigerator, comprising:

a cabinet including one or more food compartments and one or more doors closing the one or more food compartments;

an ice maker disposed in the cabinet to produce ice;

a storage bin configured to store ice produced by the ice maker;

an ice mover disposed in the storage bin and configured to move ice stored, in the storage bin to a dispenser output in response to user input to dispense ice;

a shut off arm positioned to sense an amount of ice stored in the storage bin;

a shut off arm position sensor operably coupled to the shut off arm and configured to sense a plurality of positions of the shut off arm; and a controller coupled to the ice maker, the ice mover and the shut off arm position sensor, the controller configured to detect potentially fused ice in the storage bin using the shut off arm position sensor, receive user input to dispense ice, and in response to the receiving the user input to dispense ice after detecting potentially fused ice in the storage bin using the shut off arm position sensor, temporarily disable the ice mover and alert a user of potentially fused ice in the storage bin.

23. A refrigerator, comprising:

a cabinet including one or more food compartments and one or more doors closing the one or more food compartments;

an ice maker disposed in the cabinet to produce ice;

a storage bin configured to store ice produced by the ice maker;

a shut off arm positioned to sense an amount of ice stored in the storage bin;

a shut off arm position sensor operably coupled to the shut off arm and configured to sense a plurality of positions of the shut off arm; and a controller coupled to the ice maker and the shut off arm position sensor, wherein the controller is configured to detect potentially fused ice in the storage bin using the shut off arm position sensor, and wherein the controller is configured to detect potentially fused ice in the storage bin by detecting a drop in ice level in the storage bin using the shut off arm position sensor;

wherein the controller is further configured to detect a predetermined event during operation of the refrigerator, and to detect potentially fused ice in the storage bin by detecting the drop in ice level in the storage bin using the shut off arm position sensor after detecting a presence or absence of the predetermined event;

wherein the predetermined event is a door open event when a door to a freezer compartment has been opened, an ice dispense event when ice is dispensed from an ice dispenser, a defrost event when a defrost cycle is run in the freezer compartment, or an above freezing event when an above freezing temperature is detected in the freezer compartment.

* * * * *